US005316185A

United States Patent [19]

Meenan

[11] Patent Number: 5,316,185

[45] Date of Patent: May 31, 1994

[54] LEVER ACTION SPRAY PUMP DISPENSER

[75] Inventor: Joseph E. Meenan, Pleasantville, N.Y.

[73] Assignee: Chesebrough-Pond's USA Co., Division of Conopco, Inc., Greenwich, Conn.

[21] Appl. No.: 69,969

[22] Filed: May 28, 1993

[51] Int. Cl.[5] ..... B65D 88/54

[52] U.S. Cl. ..... 222/321; 222/402.15

[58] Field of Search ..... 222/321, 472, 402.13, 222/402.15; 239/333

[56] References Cited

U.S. PATENT DOCUMENTS 3,138,331 6/1964 Kutik ..... 239/337
3,611,820 10/1971 Hempel ..... 222/402.13 X
4,061,250 12/1977 Tada ..... 222/321
4,186,855 2/1980 Edman et al. ..... 222/321
4,449,647 5/1984 Reed et al. ..... 222/402.13 X

FOREIGN PATENT DOCUMENTS 2064666 10/1992 Canada .
0402636 12/1990 European Pat. Off. .

*Primary Examiner*—Gregory L. Huson
*Attorney, Agent, or Firm*—Milton L. Honig

[57] ABSTRACT

A spray pump dispenser is described with a lever operated spray actuator mechanism, the lever being contouringly formed in a cap of the mechanism. A pair of guide posts on a plunger of the pump maintain proper orientation of the plunger during downward movement through cooperation with a pair of elongated ribs on an inner side wall of the cap. The aforementioned features prevent rotation of the plunger and control the spray direction as spray exits through a window in the cap.

7 Claims, 2 Drawing Sheets

LEVER ACTION SPRAY PUMP DISPENSER

BACKGROUND OF THE INVENTION

1. Field of the Invention

The invention concerns a lever activated spray pump dispenser, especially for cosmetic products such as antiperspirants/deodorants and haircare treatments.

2. The Related Art

Spray pumps can be fatiguing to use because of the small size of the actuator and the frictional movement of the product through the pump. In commercial pumps it is not unusual for the actuator to rotate during operation. Rotation emits spray in unintended directions.

Levered caps have been disclosed in the art as a mechanism for achieving easier depression of the pump actuator. Advantage arises from the mechanical force multiplier of the lever. For instance, U.S. Pat. No. 4,186,855 (Edman et al.), describes a pump actuating lever pivotally mounted on a bottle supporting handle assembly. The assembly is removably securable about a threaded portion of the bottle. Fatigue is said to be eliminated through use of the handle assembly. A set of actuating fins on the lever engage the pump valve and maintain the pump's nozzle orientation.

EP 0 402 636 (Wella AG) discloses an aerosol can with liquid container and actuating button operated through a single-arm lever. The spray head pump is positioned inside a cap to which the lever is pivotally attached. Downward pressure on the lever actuates the spray head causing spray to exit the cap through an aligned window within the cap.

Canadian Patent Application 2,064,666 (L'Oreal) describes a still further type of lever operated spray system. The dispensing head and lever (part of a cap) are coordinated to move together to dispense product through a window in a wall of the cap. A series of grooves in the dispensing head cooperate with a set of fins projecting from an underside of the lever. When pressure is applied, the fins move downward onto the respective grooves, rotation of the head becomes restricted and spray is actuated through the window.

While the aforementioned technology has provided certain solutions to the fatigue and orientation problems, there still is a need for improved systems.

Accordingly, it is an object of the present invention to provide a spray pump dispenser which can be indirectly actuated with a minimum of force.

It is another object of the present invention to provide a spray pump dispenser which avoids rotation of the pump head and thereby assists in properly orienting the spray direction.

Still another object of the present invention is to provide a spray pump dispenser that can provide in an improved manner cosmetic compositions to the body, especially antiperspirants/deodorants and haircare treatments.

SUMMARY OF THE INVENTION

A spray pump dispenser is provided including:

a container with an opening at an opening at an upper end thereof;

a pump mounted atop the upper end;

a vertically moveable plunger to operate the pump, the plunger being positioned above the pump, the plunger including:

a head with cylindrical outer wall;

a spray nozzle opening in the outer wall;

an upper surface orthogonal to the cylindrical wall defining an upper end of the head; and a pair of guide posts projecting outwardly from opposite sides of the cylindrical outer wall, the posts being equidistant from the spray nozzle opening;

a lever actuator mechanism including:

a cap fitted over and surrounding the pump and plunger, the cap being defined by a front, a top, a back, and a pair of side walls, the front wall having a window, the top wall having an opening, and the side walls on an inner surface thereof each having an elongated rib protruding inwardly toward the pump, the ribs being symmetrically positioned opposite one another and symmetrically flanking the window;

a lever with outer and inner major surfaces pivotally attached to a border of the opening in the top wall and form fittingly occupying the opening, the inner major surface having a pair of fins protruding therefrom downwardly to contact the upper surface of the plunger, whereupon downward pressure on the lever causes the fins to press the plunger in a downward direction to activate the pump to emit a spray, the pair of ribs interacting with the pair of guide posts on the plunger to properly position the plunger so that the spray nozzle opening is oriented opposite the window and a spray can exit therethrough onto its intended target.

Ease of usage is further advanced by the rectangular shape of the pump dispenser. Particularly significant is the oblong shape of the cap which occupies more than half the length of the dispenser.

The lever is L-shaped on an end opposite its pivoting end and adjacent the rear wall of the cap. Flanking sides of the lever each include a nib jutting outwardly therefrom. Corresponding nibs are located on an inner surface of each of the side walls along a border of the opening in the top wall. The nibs are each slantingly oriented with respect to the top wall of the cap. Purpose of the nibs is to prevent the lever from accidentally moving upward outside a contour of the cap opening.

Around a waist of the container along front and rear ends thereof, are a pair of notches. Flanges along an inner surface of the front and rear walls of the cap cooperatively engage the respective notches. In this manner, the cap is secured to the container in a snap-fit arrangement.

DETAILED DESCRIPTION OF THE DRAWING

The above features, advantages and objects of the present invention will more fully be appreciated through the following detailed discussion, reference being made to the drawing consisting of:

FIG. 1 which is a right side perspective view of a spray pump dispenser according to the present invention;

DETAILED DESCRIPTION

Figure 3:
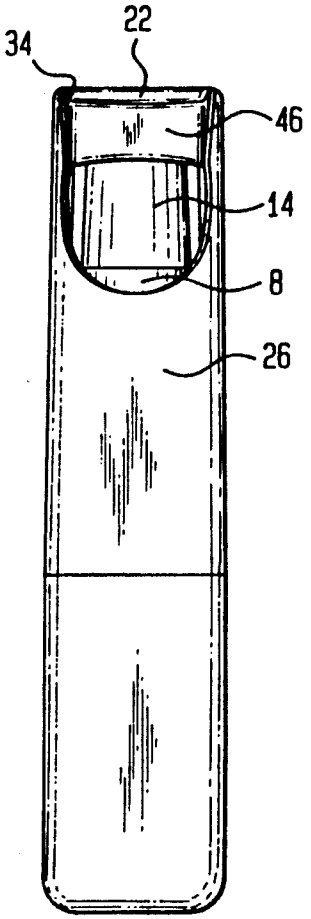
FIG. 3 is a rear perspective view of the dispenser shown in FIG. 1.
Figure 2:
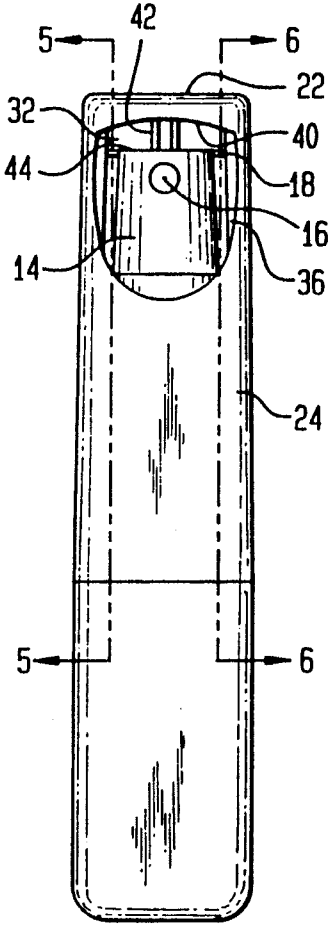
FIG. 2 is a front perspective view of the dispenser shown in FIG. 1.
Figure 1:
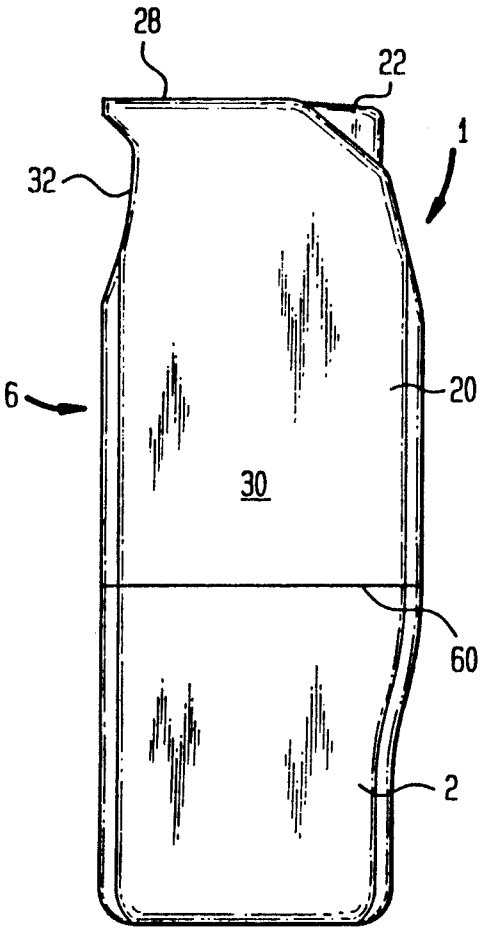
Figure 4:
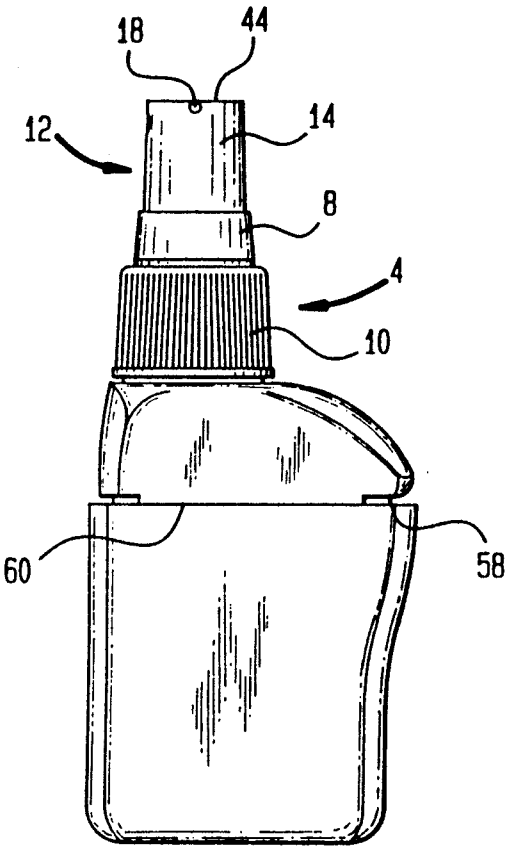
FIG. 4 is a right side perspective view of the spray pump dispenser shown in FIG. 1, except without the lever actuator mechanism.

FIG. 1 illustrates a spray pump dispenser 1 and includes a container 2 within which a liquid product is stored, a pump mechanism 4 and a lever actuator mechanism 6. FIGS. 2–4 detail the pump and lever actuator mechanisms. Component parts of the pump 17 mechanism 6 include a pump 8 mounted atop an upper end 10 of container 2 and a vertically movable plunger 12 positioned above pump 8. Plunger 12 is defined by a head 14 with a cylindrical outer wall, a spray nozzle opening 16 and a pair of guide posts 18. The guide posts 18 project perpendicularly outward from opposite ends of the cylindrical outer wall of head 14. Each of the guide posts 18 are equidistant from the spray nozzle opening 16.

The lever actuator mechanism 6 includes a cap 20 and a lever 22. The cap is fitted over and surrounds the pump 8 and plunger 12. Cap 20 is defined by a front wall 24, a rear wall 26, a top wall 28 and a pair of side walls 30. Front wall 24 is fitted with a window 32 while top wall 28 has an opening 34. Side walls 30 on an inner surface thereof each have an elongated rib 36 protruding inwardly toward pump mechanism 4. The ribs 36 are symmetrically positioned opposite one another and symmetrically flank the window 32.

Figure 6:
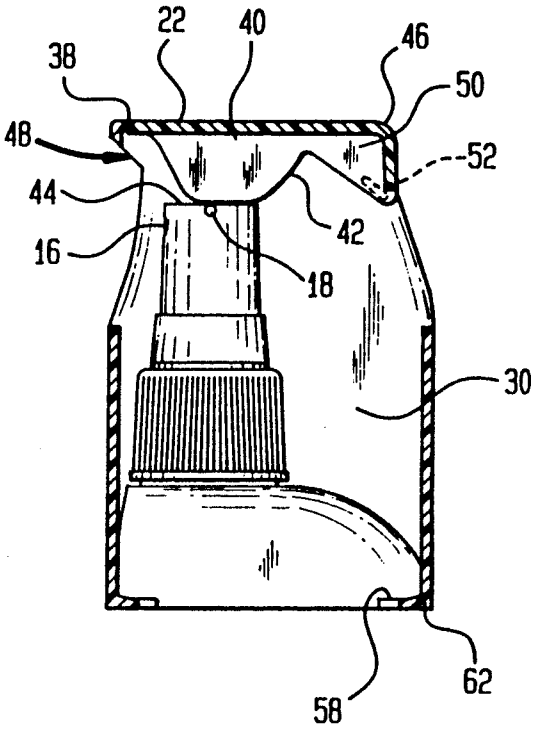
FIG. 6 is a cross-sectional view along lines VI—VI of the lever actuator mechanism and a portion of the pump/container above the dispenser waist, shown in FIG. 2.
Figure 5:
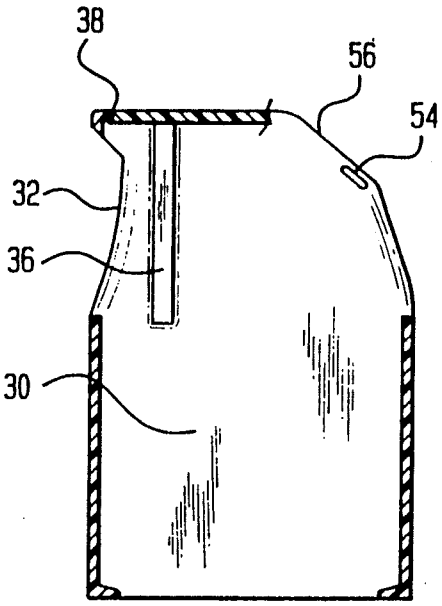
FIG. 5 is a cross-sectional view along lines V—V of the lever actuator mechanism as shown in FIG. 2.

FIG. 6 best illustrates the lever 22 pivotally attached via hinge 38 to the top wall 28 of cap 20. Lever 22 form-fittingly occupies opening 34 in the top wall 28. An inner major surface 40 of the lever is fitted with a pair of fins 42 protruding therefrom downwardly to contact an upper surface 44 of the plunger 12.

Lever 22 is L-shaped on an end 46 opposite the hinged end 48 and adjacent the rear wall 26 of the cap. Flanking sides 50 of lever 22 each include a nib 52 jutting outward therefrom. Corresponding nibs 54 are located on an inner surface of each of the side walls 30 along a border 56 of the top opening 34. Furthermore, nibs 54 are each slantingly oriented at an acute angle with respect to top wall 28 of cap 20. Purpose of nibs 52, 54 is to prevent the lever 22 from accidently moving upward outside the contour of the cap opening 34 and also prevent plunger 12 from activating in transit.

FIG. 4 best illustrates a pair of notches 58 around a waist 60 of container 2 along front and rear ends thereof. Flanges 62 along an inner surface of the front and rear walls of the cap cooperatively can engage respective notches 58. In this manner, cap 20 is secured to the container 2 in a snap-fit arrangement.

According to the present invention the spray pump dispenser operates in the following manner. Finger pressure is applied to a top surface of lever 22. As the lever is depressed, the fins 42 apply pressure to the upper surface 44 of plunger 12. Thereupon, plunger 12 moves downward actuating pump 8. A vacuum created in container 2 then forces product spray through the spray nozzle opening 16.

Orientation of the plunger during the downward movement is maintained by the pair of guide posts 18 that move along rear edges of ribs 36. In this manner, the spray nozzle opening is properly positioned opposite window 32 so that the spray can exit therefrom accurately onto its intended target.

The foregoing description illustrates selected embodiments of the present invention. In light thereof, various modifications will be suggested to one skilled in the art, all of which are within the spirit and purview of this invention.

What is claimed is:

1. A spray pump dispenser comprising:
a container with an opening at an upper end thereof;
a pump mounted atop said upper end;
a vertically moving plunger to operate said pump, said plunger being positioned above said pump, said plunger comprising:
a head with a cylindrical outer wall;
a spray nozzle opening in said outer wall;
an upper surface orthogonal to the cylindrical wall defining an upper end of said head; and
guide means for orienting said spray nozzle, said guide means projecting outwardly from opposite sides of said cylindrical outer wall;
a lever actuator mechanism comprising:
a cap fitted over and surrounding said pump and plunger, said cap being defined by a front, a top, a rear, and a pair of side walls, said front wall having a window, said top wall having an opening, and said side walls on an inner surface thereof each having an elongated rib protruding inwardly toward said pump, said ribs being symmetrically positioned opposite one another and symmetrically flanking said window;
a lever with outer and inner major surfaces pivotally attached to a border of said opening in said top wall and form fittingly occupying said opening, said inner major surface having a pair of fins protruding therefrom downwardly to contact said upper surface of said plunger, whereupon downward pressure on said lever causes said fins to press said plunger in a downward direction to activate said pump to emit a spray, said pair of ribs interacting with said guide means on said plunger to properly position said plunger so that said spray nozzle opening is oriented opposite said window and a spray therefrom can exit onto its intended target.

2. The dispenser according to claim 1 wherein said lever is L-shaped on an end opposite an end to which said lever is pivotally attached and adjacent said rear wall of said cap.

3. The dispenser according to claim 2 wherein said lever further includes flanking sides, each of said flanking sides having a nib jutting outwardly therefrom.

4. The dispenser according to claim 3 further comprising corresponding nibs located on an inner surface of each of said side walls along a border of said top wall opening of said cap, said nibs on said lever and said corresponding nibs cooperatively interacting to prevent said lever from accidentally moving upward outside a contour of said opening formed in said top wall of said cap and prevent activation of the pump during transit.

5. The dispenser according to claim 1 further comprising along a waist of said container on a front and rear end thereof, a pair of notches.

6. The dispenser according to claim 5 further comprising flanges along an inner surface of said front and rear walls of said cap cooperatively engaging respectively said notches to secure said cap onto said container in a snap-fir arrangement.

7. The dispenser according to claim 6 wherein said corresponding nibs are each slantingly oriented with respect to said top wall of said cap.

* * * * *